US005090192A

United States Patent [19]

Stahlecker

[11] Patent Number: 5,090,192

[45] Date of Patent: Feb. 25, 1992

[54] PROCESS AND AN ARRANGEMENT FOR FALSE-TWIST SPINNING

[75] Inventor: Fritz Stahlecker, Bad Überkingen, Fed. Rep. of Germany

[73] Assignee: Hans Stahlecker, Fed. Rep. of Germany; a part interest

[21] Appl. No.: 567,787

[22] Filed: Aug. 15, 1990

[30] Foreign Application Priority Data

Aug. 23, 1989 [DE] Fed. Rep. of Germany ..... 3927739

[51] Int. Cl.[5] ..... D01H 5/28

[52] U.S. Cl. ..... 57/328; 57/90; 57/315; 57/333

[58] Field of Search ..... 57/328, 333, 401, 90, 57/315, 408, 411

[56] References Cited

U.S. PATENT DOCUMENTS

| | | | |
|---|---|---|---|
| 3,487,619 | 1/1970 | Field | 57/328 |
| 4,290,170 | 8/1981 | Brookstein et al. | 57/315 X |
| 4,488,397 | 12/1984 | Venot | 57/328 |
| 4,583,355 | 4/1986 | Vignon | 57/328 X |
| 4,697,411 | 10/1987 | Artzt et al. | 57/401 |
| 4,698,960 | 10/1987 | Nerli et al. | 57/401 |
| 4,724,668 | 2/1988 | Wassenhoven | 57/333 |
| 4,858,420 | 8/1989 | Stahlecker et al. | 57/328 |
| 4,953,349 | 9/1990 | Fehrer | 57/315 |

FOREIGN PATENT DOCUMENTS

| | | | |
|---|---|---|---|
| 0057876 | 8/1985 | European Pat. Off. . | |
| 0085017 | 4/1986 | European Pat. Off. . | |
| 0305971 | 3/1989 | European Pat. Off. . | |
| 2416880 | 3/1979 | Fed. Rep. of Germany . | |
| 3310285 | 10/1986 | Fed. Rep. of Germany . | |
| 3631400 | 3/1988 | Fed. Rep. of Germany . | |
| 3714212 | 11/1988 | Fed. Rep. of Germany . | |
| 2215743 | 9/1989 | United Kingdom | 57/90 |

*Primary Examiner*—Daniel P. Stodola
*Assistant Examiner*—William T. Stryjewski
*Attorney, Agent, or Firm*—Evenson, Wands, Edwards, Lenahan & McKeown

[57] ABSTRACT

In an arrangement for false-twist spinning, a yarn guiding element is arranged between a drafting unit and a false-twisting nozzle which moves in the travelling direction of the yarn at a speed which is higher than the delivery speed and the withdrawal speed.

23 Claims, 9 Drawing Sheets

PROCESS AND AN ARRANGEMENT FOR FALSE-TWIST SPINNING

BACKGROUND AND SUMMARY OF THE INVENTION

The invention relates to a process for false-twist spinning in which the fiber material first travels through a drafting unit, then through at least one false-twisting nozzle and subsequently through a withdrawal device. The false-twist distribution in the yarn between the false-twisting nozzle and the drafting unit is influenced such that the false twist in the inlet area of the false-twisting nozzle is larger than in the outlet area of the drafting unit. The invention also relates to an arrangement for performing this false-twist spinning process.

In a process and an arrangement of the initially mentioned type described in German Patent Document DE-A 36 31 400, devices are arranged between the drafting unit and the following false-twisting nozzle, by which a twisting brake is created by means of which the false twist is weakened which extends back in the yarn from the false-twisting nozzle to the drafting unit. In some embodiments, the guiding elements, which are driven to perform rotations around an axis transversely to the travelling direction of the yarn, form a deflection having a guiding surface moving in the travelling direction of the yarn. By this measure, the spreading-away of the edge fibers or fiber ends is to be facilitated and made more uniform.

It is also known from German Patent Document DE-A 37 14 212 to arrange between the drafting unit and the false twisting nozzle a rotating guiding element to which devices are assigned for changing the travelling direction of the yarn transversely to the direction of the movement of the rotating guiding element. As a result, the fiber structure is to be loosened so that the sliver widens in the transverse direction before it enters into the air nozzle.

It is also known from European Patent Document EP-B 0 057 876 to provide a deflecting roller between a drafting unit and a false-twisting nozzle which has the purpose of deflecting the sliver in such a manner that, as a result of generated centrifugal forces, fibers are spread away which subsequently are to wind around the yarn core.

It is also known from European Patent Document EP-B 0 085 017 to connect a compressing roller in the form of a roller provided with a flute behind a drafting unit, the groove base of which is subjected to suction. As a result, the sliver is to be compressed. This compressing roller is to have the effect that the twist provided to the yarn by the spinning element which follows is limited completely to the area between the twisting element and the compressing roller so that the area between the drafting unit and the compressing roller remains completely untwisted. The untwisted condition of the sliver in the area between the delivery rollers of the drafting unit and the compressing roller has the purpose of making it possible that, as a result of the compressing roller, a positive and a negative draft can be obtained and the delivery roller can be driven at a speed which corresponds to the delivery speed or differs from it.

It is also known from European Patent Document EP-A 0 305 971 to connect behind a drafting unit a pair of disks which rotate in opposite directions and which have a nip area and an annular sieve area subjected to suction.

It is also known from German Patent Document DE-C 24 16 880 to provide transfer conveyor belts between a pair of delivery rollers of a drafting unit and false-twisting nozzles which follow, which transfer conveyor belts wind around the rollers of the pair of delivery rollers and open up in the travelling direction of the yarn.

It is also known from German Patent Document DE-C 33 10 285 to provide a sliding surface, which moves transversely with respect to the yarn travelling direction, between the delivery rollers of a drafting unit and a turning-in device for the fiber roving, this sliding surface having the purpose of bending projecting fiber ends transversely with respect to the yarn axis.

It is an object of the invention to provide a process of the initially mentioned type by which the yarn quality is improved.

This object is achieved according to the invention by accelerating the edge fibers of the yarn in the area between the drafting unit and the inlet area of the false twisting nozzle in the travelling direction of the yarn to a higher speed than the core of the yarn.

In this development according to the invention, in addition to the influencing of the false-twist distribution, according to which a greater false twist is obtained in the inlet area of the false-twisting nozzles than in the outlet area of the drafting unit, it is also provided that edge fibers or fiber ends are detached and, in comparison to the core of the yarn having a lower speed, are accelerated in the direction toward the false-twisting nozzle. As a result, on the one hand, the number of the detached fiber ends which later wind around the yarn is increased and made more uniform while, on the other hand, the slope of the windings becomes steeper than had been previously possible. As a result, a yarn or a thread is produced which has a more uniform structure, and the tearing strength of which is increased by approximately 30% in comparison to comparable yarns or threads.

In a further development of the invention, it is provided that the edge fibers are accelerated to a speed which amounts to approximately 1.3 times to 1.8 times the speed of the core of the yarn. It was found that below this range, the endeavored effect, particularly the increase of the tearing strength, does not occur or occurs to a not yet very high degree, whereas above this range the endeavored effect decreases again.

In a further development of the invention, in an arrangement for false-twist spinning having a drafting unit, at least one false-twisting nozzle and a withdrawal device as well as a guiding element which is arranged between the drafting unit and the air nozzle, is driven to perform rotations around an axis disposed transversely with respect to the yarn travelling direction, and forms a deflection with a yarn guiding surface moving in the travelling direction of the yarn, it is provided that the guiding surface is driven at a speed which is higher than the delivery speed of the drafting unit and higher than the withdrawal speed of the withdrawal device.

In this arrangement, the yarn rolls along transversely to its travelling direction on the guiding surface so that a weakening of the false twist occurs originating from the false-twisting nozzle in the direction toward the pair of delivery rollers of the drafting unit as a result of the provided false twist. In this case, only the edge fibers or fiber ends are taken along by the guiding surface so that they are spread away from the yarn core and aligned. As a result, the number of the spread-away fiber ends which are later wound around the yarn is increased and made uniform. In addition, the slope of the winding clearly becomes steeper. As a result of the rolling on the moving guiding surface, it is also achieved that the yarn, as a whole, has a rounder cross-section than previously. There are practically no areas where there is no winding-around of fiber ends.

Other objects, advantages and novel features of the present invention will become apparent from the following detailed description of the invention when considered in conjunction with the accompanying drawings.

DETAILED DESCRIPTION OF THE DRAWINGS

Figure 1:
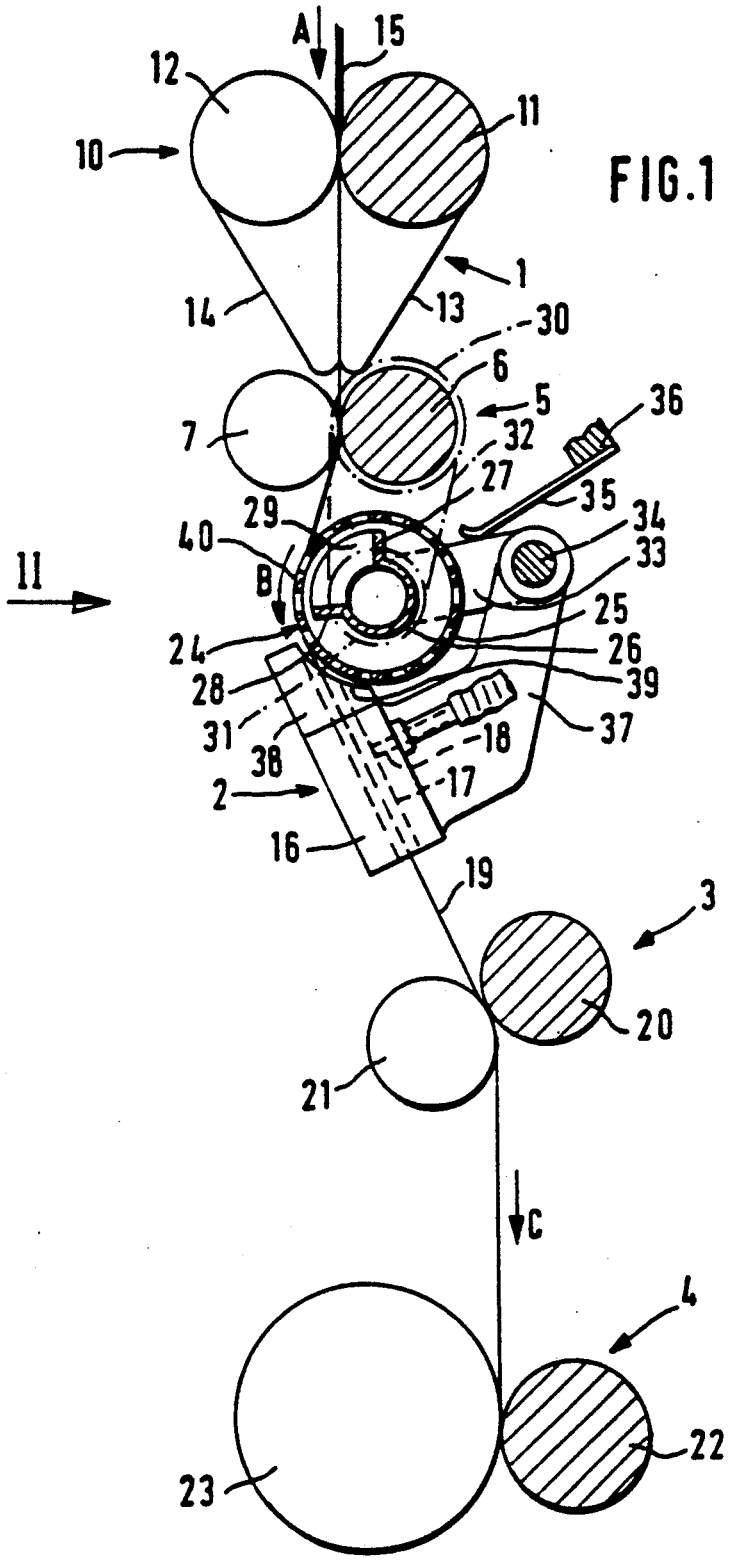
FIG. 1 is a schematic partially sectioned lateral view of an arrangement according to the invention for carrying out the process according to the invention.
Figure 2:
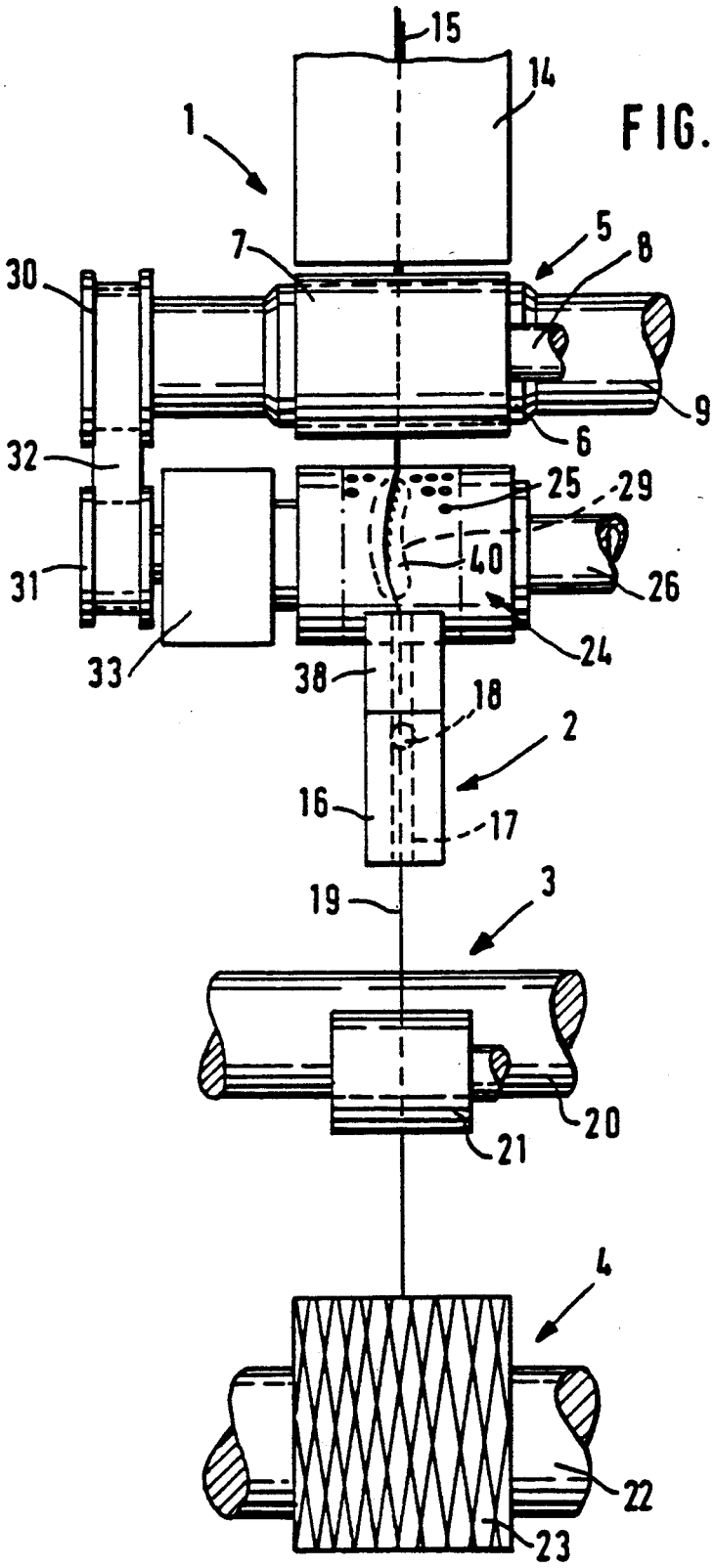
FIG. 2 is a view in the direction of the arrow II of FIG. 1.

FIGS. 1 and 2 show an individual arrangement for pneumatic false-twist spinning of a spinning machine which is provided with a plurality of arrangements of this type which are arranged in a row behind one another on one side or on both sides of the machine. The shown arrangement comprises a drafting unit 1 which, in the travelling direction of the yarn 19 to be spun, is followed by a pneumatic false-twisting device 2, a withdrawal device 3 and a wind-up device 4.

The drafting unit 1 comprises a pair of delivery rollers or a pair of outlet rollers 5 which consists of a drivable bottom roller 6 and a pressure roller 7. The bottom roller 6 may be constructed as a drivable cylinder extending through in the longitudinal direction of the machine which forms the corresponding bottom rollers 6 of all spinning arrangements. However, it may also be possible to construct the bottom roller 6 as an individual roller piece which is assigned only to the respective arrangement. The pair of delivery rollers 5 is preceded by a pair of rollers 10 which is also formed by a drivable bottom roller 11 and a pressure roller 12. A bottom apron 13 or a top apron 14 may wind around the bottom roller 11 and the pressure roller 12 and form a known apron guide which extends to closely to the wedge-shaped gap of the pair of delivery rollers 5. The drafting unit 1 also comprises one or more additional pair of rollers which are not shown. The sliver 15 to be drafted travels through the drafting unit 1 in the direction of the arrow (A).

The false-twisting device 2 comprises a false-twisting nozzle 16 having a yarn duct 17. At least one blow opening 18, which is connected to a compressed-air supply line, leads into the yarn duct 17 in the tangential direction.

The withdrawal device 3, which follows the false-twisting device 2, comprises a drivable bottom cylinder 20 and a pressure roller 21. The withdrawn spun yarn 19 will then travel in the direction of the arrow (C) to the wind-up device 4 which comprises a drivable roller 22 extending through in the longitudinal direction of the machine on which a spool package 23 rests onto which the yarn 19 is wound. The wind-up device 4 is outlined in a simplified manner. In a known manner, it comprises a spool package holding device and a cross-winding device as well as possibly additional elements.

A guiding element in the form of a roller 24 is arranged between the pair of delivery rollers 5 of the drafting unit 1 and the false-twisting device 2. The roller 24 rotates around an axis extending in parallel to the bottom roller 6 and forms a cylindrical guiding surface for the sliver leaving the drafting unit 1. Roller 24, which has a slightly larger diameter than the bottom roller 6, is provided with a drive tapped from it. For this purpose, a gear wheel 30 is arranged on the bottom roller 6 or on the shaft 9 which is part of it, this gear wheel 30, by way of a toothed belt 32, driving a gear wheel 31 which is arranged on a shaft which is non-rotatably connected with the roller 24. In the area of the guiding surface 40, the roller 24 is provided with a perforation 25. In the interior of the roller 24, a suction device 26 is arranged which is connected to a vacuum source. The suction device 26 is provided with a suction slot 29 which is open toward the area of the guiding surface 40 and which is bounded by webs 27, 28 projecting to close to the interior wall of the roller 24.

The shaft of the roller 24 is disposed in a swivel arm 33 which can be swivelled around a stationary shaft 34. A spring 35 rests against the swivel arm 33 and is mounted on a stationary holding part 36. The spring 35 loads the swivel arm 33 in such a manner that a force is applied to the shaft of the roller 24 which is directed away from the bottom roller 6 and tightens the toothed belt 32.

Another swivel lever 37 is arranged on the shaft 34 and carries the false-twisting nozzle 16. As shown in FIG. 1, the inlet area 38 of the false-twisting nozzle 16 is provided with a partially cylindrical recess 39 so that the air duct 17 starts very close to the roller 24.

As shown in FIG. 1, the roller 24 deflects the yarn travel with respect to the travelling direction (A) of the sliver. The false-twisting nozzle 16 is disposed in the tangential plane of the nip line of the withdrawal device 3 with respect to the roller 24; i.e., its air duct 17 is disposed in this tangential plane.

The speed at which the yarn 19 moves between the pair of delivery rollers 5 and the withdrawal device 3 is determined by the speeds of the pair of delivery rollers 5 and the withdrawal device 3. Normally, the operation takes place with a low negative draft; i.e., the withdrawal speed of the withdrawal device 3 is slightly lower than the delivery speed of the pair of delivery rollers 5. The roller 24 which is arranged between the pair of delivery rollers 5 and the false-twisting device 2 is driven at a comparatively increased speed; i.e., the yarn guiding surface 40 on the cylindrical shell of the roller 24 has a speed which amounts to 1.3 times to 1.8 times the delivery speed. As a result of these speed conditions, the roller 24 carries out a relative speed which moves ahead of the yarn 19; i.e., the yarn 19 slides on the guiding surface 40. In the process, edge fibers or fiber ends are detached from the core by the guiding surface 40 moving in the direction of the arrow B which will then move slightly faster than the core of the yarn 19. As a result of the providing of the false twist in the false-twisting device 2, the yarn 19 carries out a rotational movement around its yarn axis by means of which it rolls slidingly on the guiding surface 40. In this case, the guiding surface 40 is used as a device for preventing the propagation of the false twist so that a higher false twist exists in the yarn in the inlet area of the false-twisting nozzle 16 than in the area behind the pair of delivery rollers 5. However, in this case, it is to be ensured that the propagation of the false twist is ensured from the false-twisting device 2 to the pair of delivery rollers 5 of the drafting unit 1. The intensity of the propagation of the false twist may be affected by the length of the guiding surface 40; i.e., over which length the yarn 19 slides on the guiding surface 40. This, in turn, is a function of the position and the diameter of the roller 24. In addition, the propagation of the twist may be controlled by the intensity of the vacuum applied to the suction device 26. As shown in FIGS. 1 and 2, the suction slot 29 extending in the travelling direction of the yarn is essentially directed to the area in which a weakened twist exists in the yarn. It is assumed that in this area fiber ends detach better from the fiber core and can be taken along better by the guiding surface 40 while moving ahead of the yarn core, as illustrated in FIG. 2. In the area of the increased false twist, which follows, these fiber ends are then wound around the yarn core. After the opening-up of the false twist, these yarn ends remain bound around the yarn core. In order to facilitate the rolling of the yarn on the guiding surface 40, by which the spreading-away and the taking-along of the fiber ends may possibly be improved, the suction slot 29 has a contour which is curved in an arched manner corresponding to FIG. 2. By the rolling on the guiding surface 40, it is also achieved that the sliver, which at first leaves the pair of delivery rollers 5 in a flat shape, rolls together to form a structure with a largely circular cross-section and becomes more uniform. On the whole, a yarn 19 is obtained which distinguishes itself by an improved roundness as well as by a more uniform winding-around by means of fiber ends which, in addition, are also wound around the yarn core with a relatively steep slope.

As also indicated in FIG. 2, the pressure rollers 7 of two adjacent spinning units are disposed on a common shaft 8. This shaft 8, just like the shafts of the preceding pressure rollers, is disposed in a common supporting and loading arm; i.e., the pressure rollers of two adjacent spinning points are constructed as so-called twin pressure rollers.

Figure 3:
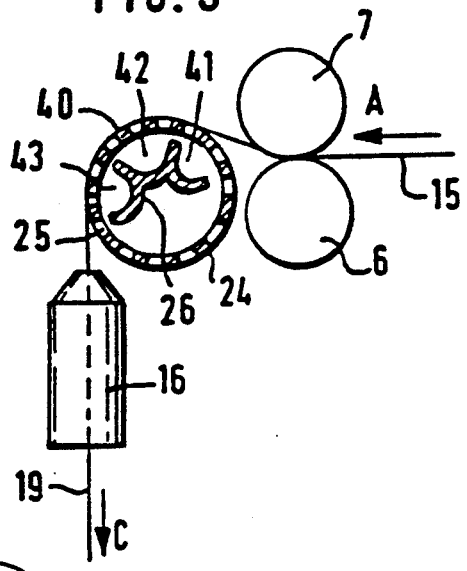
FIG. 3 is a schematic partially sectioned lateral view of another embodiment having a roller subjected to suction which is used as the guiding surface.

In its basic construction, the embodiment according to FIG. 3 corresponds to the embodiment according to FIG. 1 and 2. The essential difference is the fact that the suction insert 26 is divided such that a suction slot is formed which has three different sections 41, 42 43 situated behind one another in the travelling direction of the yarn which are all disposed in the area of the guiding surface 40. By means of this division of the suction slot into several sections 41, 42, 43, it becomes possible to adjust correspondingly different pressure conditions and have these pressure conditions affect the yarn 19. In particular, it is possible to apply a particularly high vacuum to the area of the first section 41 following the delivery rollers 6, 7, while a lower vacuum is provide din the sections 42, 43 which follow or possibly, in the last section 43, even an excess pressure is provided. As a result, it also becomes possible to influence the moving-back of the false twist from the false-twisting nozzle 16 to the wedge-shaped gap of the delivery rollers 6, 7. In addition, if an excess pressure is applied to the last section 43, the wind-around angle may also be changed by which the yarn 19 winds around the guiding surface 40 of the roller 24.

Figure 4:
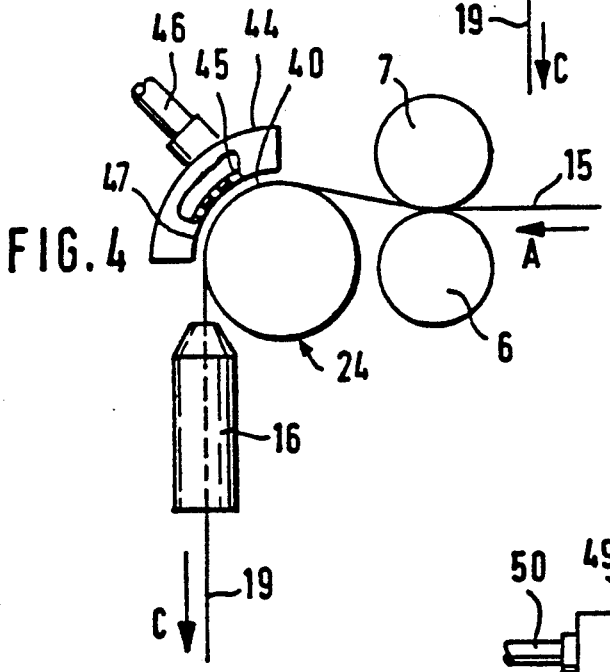
FIG. 4 is a schematic partially sectioned view of another embodiment having a roller serving as the guiding surface opposite of which is a suction device.

In the embodiment according to FIG. 4, it is provided that the roller 24 forming a guiding surface 40 and arranged between the delivery rollers 6, 7 and the false-twisting nozzle 16 has a closed shell surface. On the side facing away from the yarn 19, a suction device 44 is disposed opposite the guiding surface 40, has a contour 47 which is adapted to the cylindrical contour of the roller 24, and surrounds it in the area of the guiding surface 40. The suction arrangement 44 is connected to a vacuum source 46. The contour 47 is covered by a sieve or a perforation. Also in this embodiment, the roller 40 moves faster than the yarn so that the fiber ends are detached and are aligned in the travelling direction of the yarn 19. In this case, the suction device 44 will contribute to the spreading-away and corresponding stretching of these edge fibers. Also in this embodiment, the effect of the suction device 44 is transverse to the travelling yarn 19, the suction device extending in the direction of the yarn travel.

Figure 5:
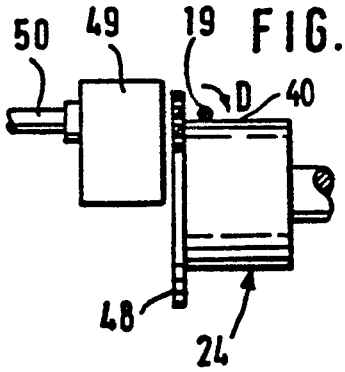
FIG. 5 is a schematic partial view of an embodiment having a roller serving as a guiding surface and with an axially directed suction.

In the embodiment according to FIG. 5, the also unperforated roller 24, which forms a guiding surface 40, is provided with a perforated ring collar 48 to which a suction device 49 is assigned which generates a suction air flow. The suction device 49 is connected to a vacuum line 50 and, in the area of the guiding surface, generates a suction air flow directed axially toward the roller 24. As a result of the false twist having the twisting direction (D), the false-twisted yarn has the tendency to roll on the guiding surface of the roller 24. In this case, the ring collar 48 and the suction 49 are arranged such in relation to the yarn 19 that this yarn carries out a rolling motion which is directed away from the ring collar 48. This means that, in the case of the reverse turning direction of the false twist, the ring collar 48 and the suction device 49 would be arranged on the opposite side. The ring collar is therefore important essentially only during the switching-off or switching-on of the arrangement because it then determines the position of the yarn 19. If this problem does not play any role or is solved in a different manner, it is therefore possible that the ring collar 48 may not be necessary at all.

Figure 6:
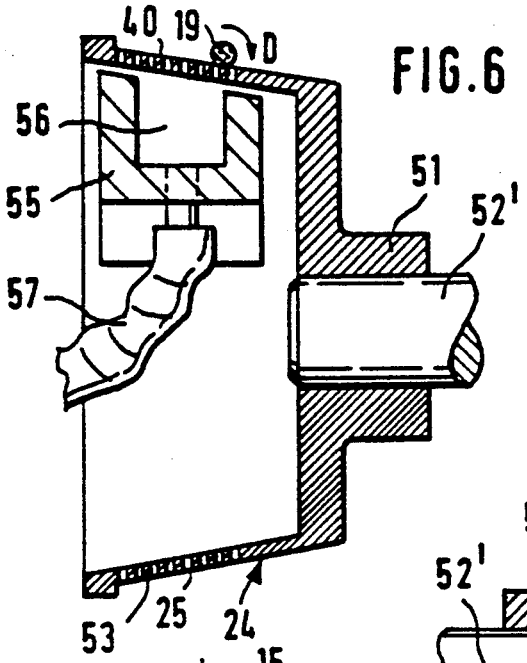
FIG. 6 is a schematic sectional view of an embodiment having a roller serving as the guiding surface and having a conical and perforated shell, with a suction device arranged in the interior.

In the embodiment according to FIG. 6, it is provided that a truncated-cone-shaped roller 53 is provided as the guiding element 24. By means of a projection 51 of an end face, this truncated-cone-shaped roller 53 is arranged on a driving shaft 521. The truncated-cone-shaped shell surface is provided with a perforation. In the interior of the roller 53, a stationary suction device 55 is arranged which is provided with a suction slot 56 extending in the circumferential direction; i.e., with a suction slot 56 extending in the direction of the guiding surface 40. The suction device 55 is connected to a vacuum line 57. Because of the twisting direction (D) of the false twist, the yarn 19 has the tendency to roll on the truncated-cone-shaped shell surface. However, as a result of the suction slot 56, it is held back in the area that is subjected to suction.

Figure 7:
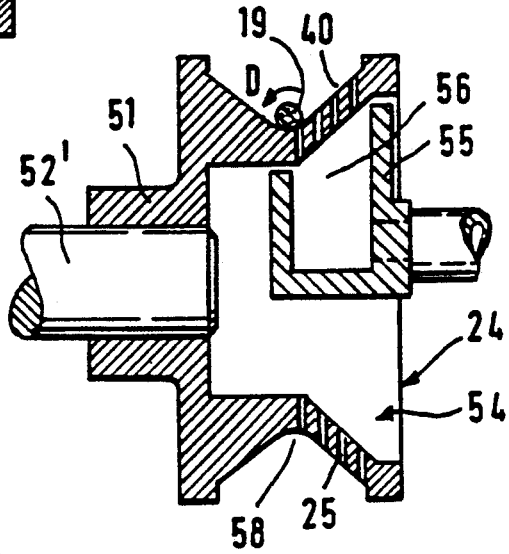
FIG. 7 is a sectional view of an embodiment similar to that of FIG. 6 in which the roller has a groove-shaped yarn guiding surface.

In the embodiment according to FIG. 7, a roller 54 is used as the guiding element 24 which is open on one side and which has a V-shaped annular groove 58 as the circumferential surface which has a considerably rounded groove base. The roller 54, by means of a hub-type projection 51, is arranged on a shaft 52. One of the two flanks of the V-shaped annular groove 58 is provided with a perforation 25 and forms the guiding surface 40. As a result of the false twist provided to the yarn 19 in the direction of the arrow (D), the yarn has the tendency to roll from this guiding surface 40 into the groove base. However, as a result of the suction air flow, it is held in the area of the perforation 25.

Figure 8:
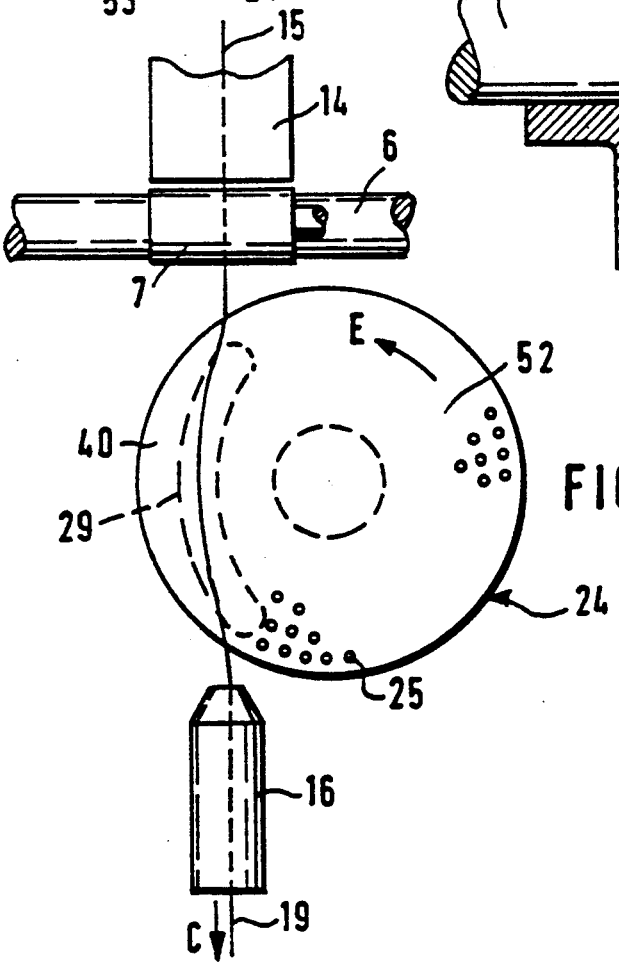
FIG. 8 is a view of an embodiment having a disk-shaped rotation element forming a guiding surface.

In the embodiment according to FIG. 8, the guiding element 24 is constructed as disk 52 which is disposed to be pivotal around an axis which is arranged essentially transversely or skew with respect to the travelling direction of the yarn 19 and is driven to perform rotational movements in the direction of the arrow (E). The disk 52 forms a guiding surface 40 against which the yarn 19 rests and which moves at a speed which is increased in comparison to the delivery rollers 6, 7 and also in comparison to the withdrawal device which is not shown. The rear of the disk 52 provided with a perforation 25 is subjected to suction; i.e., a suction device is assigned to it which, by means of a suction slot 29, acts in the area of the guiding surface 40. The suction slot 29 has a bend which corresponds essentially to the escaping motion of the yarn 19 rotating as a result of the false twist.

Figure 9:
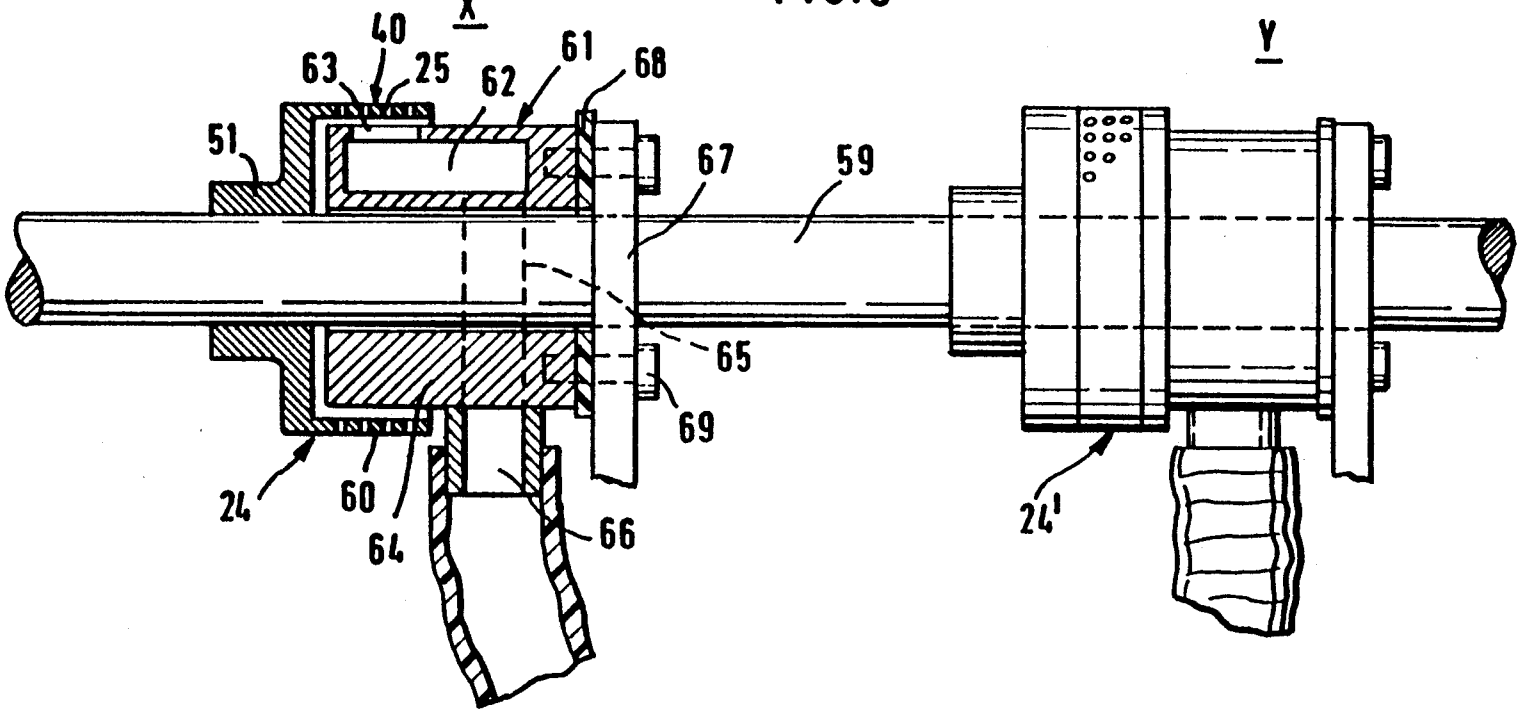
FIG. 9 is a view of an embodiment having an arrangement of several roller-shaped rotation elements of several arrangements on a common drive shaft.

In the case of a yarn breakage, the yarn guiding elements 24 are not stopped but may continue to move. It is therefore possible to equip the guiding elements 24 with a common drive, as shown, for example for the guiding elements 24, 24' of FIG. 9 of two adjacent arrangements (X, Y). In the embodiment according to FIG. 9, rollers 60 are provided as the guiding elements 24, 24' which are mounted on one side by means of a hub 51 on a shaft 59 which extends through in the longitudinal direction of the machine. In their cylindrical area, the rollers 60 are provided with a perforation 25 which, corresponding to FIG. 1 and 2, forms a guiding surface 40 for the yarn. A suction device 61 projects into the interior of the rollers 60 and has a suction chamber 63 with a suction slot 63 extending in the circumferential direction of the rollers 60. By means of a connection 66, the suction chambers 62 are connected to a suction line. The suction devices 61 are stationarily mounted on a holder 67 of the machine. On this holding part 67, the suction devices are fastened by means of screws 69 with the insertion of an elastic intermediate layer 68. The suction device 61 is arranged at a distance from the shaft 59. As shown in FIG. 9, it may be supplemented by a supplementary piece 64 so that the whole hollow space of the rollers 60 is filled in.

Figure 10:
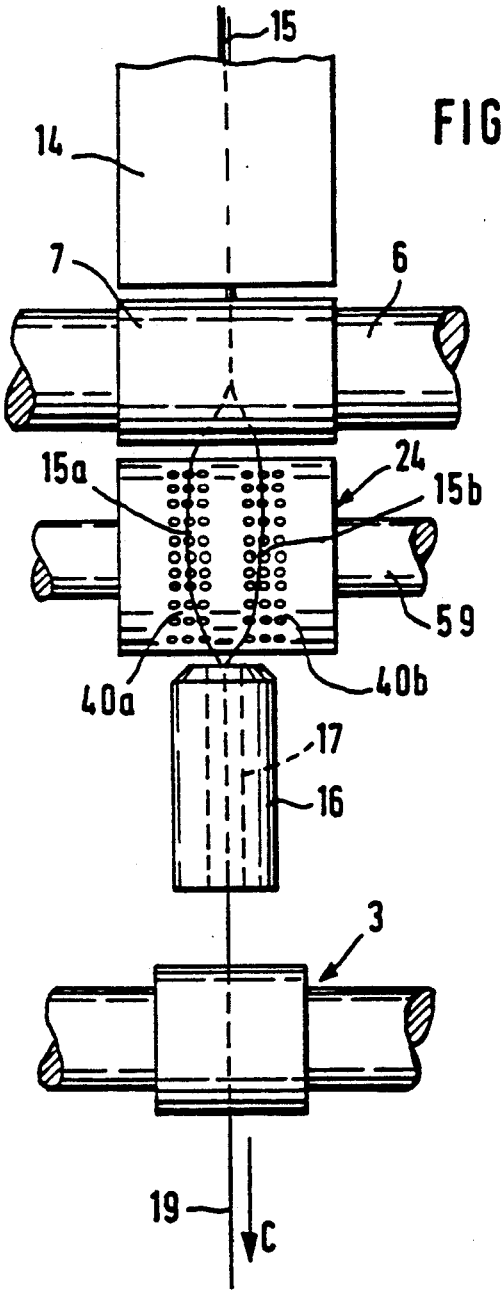
FIG. 10 is a view similar to FIG. 2 of an embodiment with devices for dividing the sliver leading the drafting unit and a common false-twisting nozzle which follows.

In its basic construction, the embodiment according to FIG. 10 corresponds to the embodiment according to FIG. 1 and 2. However, the roller-shaped guiding element 24 is provided with two guiding surfaces **40*a*, 40*b* in the area of which perforations and a suction device, which is not shown, are respectively arranged. The sliver delivered by the delivery rollers 6, 7 is therefore oriented not only with respect to the fiber ends or edge fibers but is also divided into two components 15*a*, 15*b*. However, in the common false-twisting nozzle 16, these components 15*a*, 15*b* run together again so that a uniform yarn 19 is spun which, however, now has a twisted-yarn-type shape. The dividing of the moving-on sliver, under certain circumstances, may be promoted by elements which are not shown and which are arranged between the delivery rollers 6, 7 and the guiding element 24**.

Figure 11:
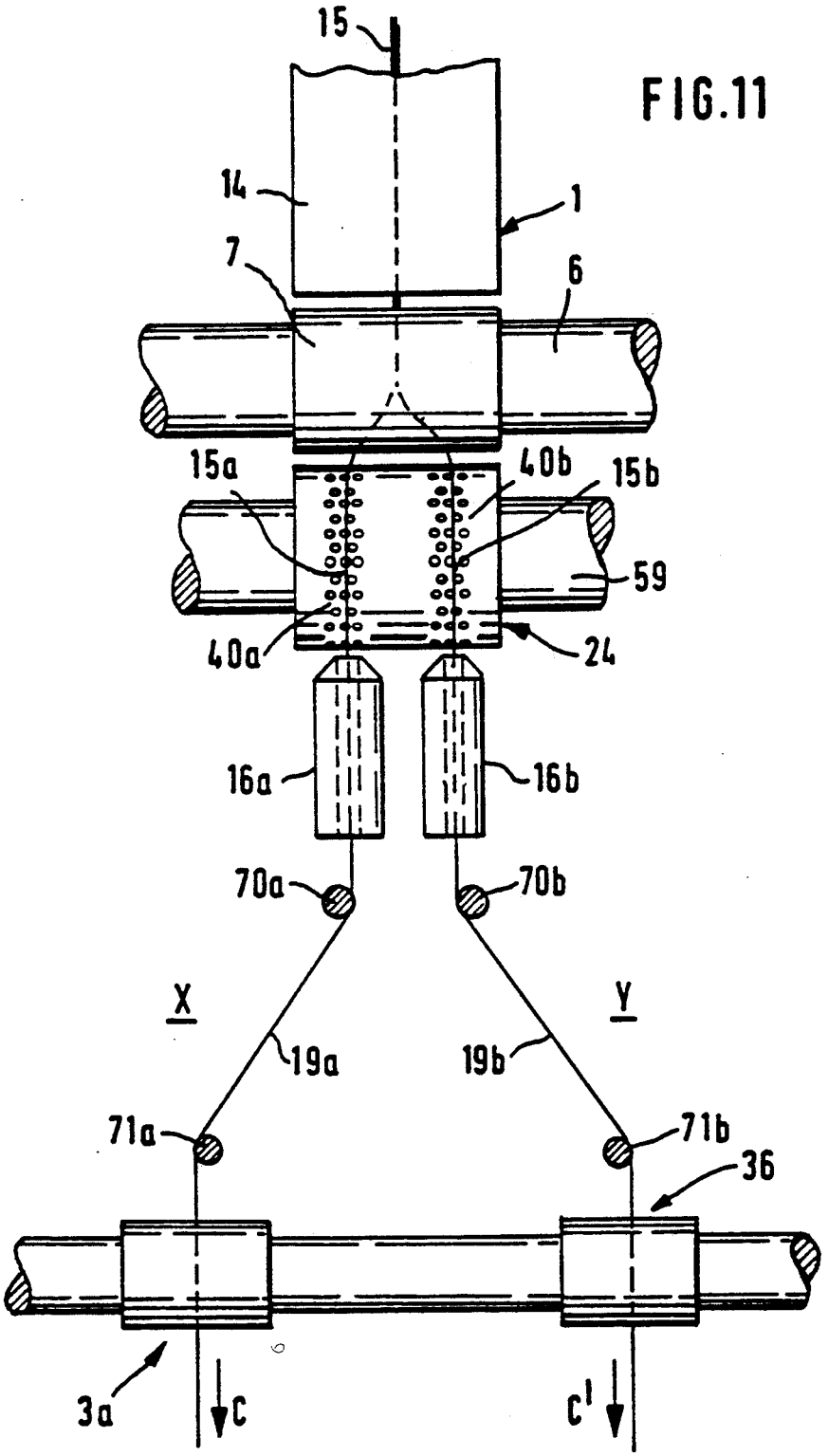
FIG. 11 is a view of an embodiment similar to FIG. 2 having two separate false-twisting nozzles for the divided sliver.

The embodiment according to FIG. 11 corresponds to the embodiment according to FIG. 10 with the difference that respective separate false-twisting nozzles **16*a*, 16*b* are provided for the divided fiber strands 15*a*, 15*b* so that two separate yarns 19*a*, 19*b* are produced which are withdrawn by their respective separate withdrawal devices 3*a*, 3*b*. Between the false-twisting nozzles 16*a*, 16*b* and the withdrawal devices 3*a*, 3*b*, yarn deflecting elements 70*a*, 70*b* and 71*a*, 71*b* are arranged which then assign the two yarns 19*a*, 19*b*** to respective adjacent wind-up devices.

Figure 12:
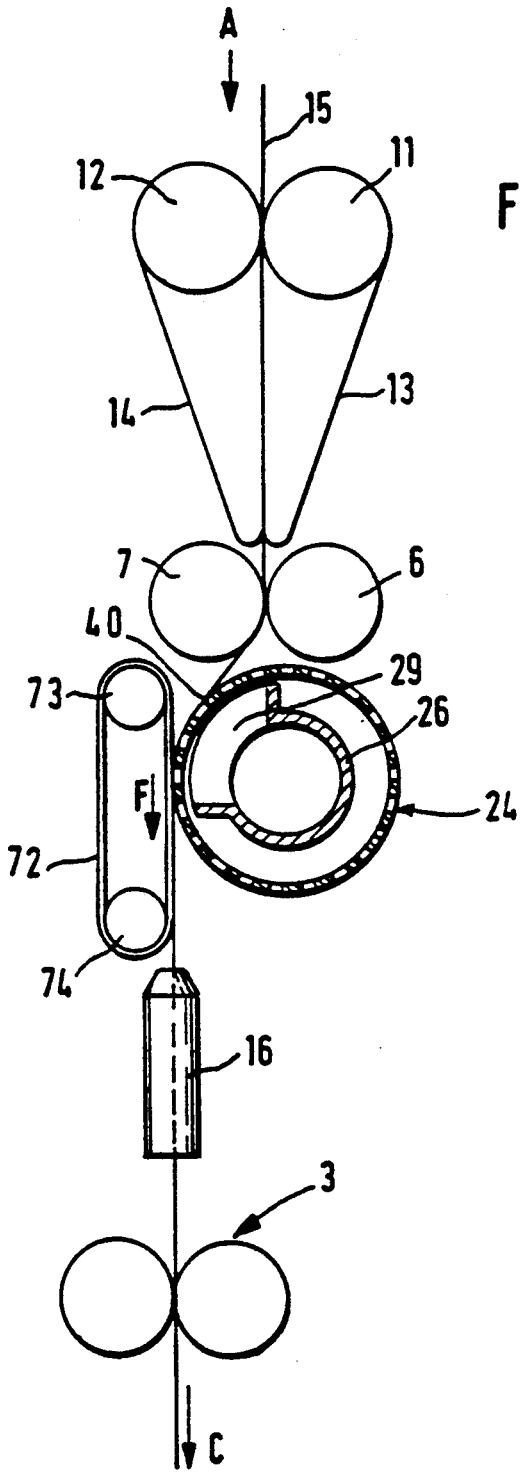
FIG. 12 is an embodiment similar to that of FIG. 1 having a contact pressure device disposed opposite the guiding surface of the roller.

In the embodiment according to FIG. 12, it is provided that the conveying direction (A) of the drafting unit 1 and the yarn travelling direction (C) in the false-twisting nozzle 16 and the withdrawal device 3 extend in the same direction but are slightly offset with respect to one another. The distance is bridged by the guiding element which is constructed as a cylindrical roller 24 and forms a guiding surface 40 for the yarn which moves in the travelling direction of the yarn at a speed which is increased in comparison to the delivery speed and the withdrawal speed. In the area of the guiding surface 40, the roller 24 is perforated and on the inside is provided with a suction insert 26 which, by means of a suction slot 29, is directed to this guiding surface 40. A contact pressure element 72 is also assigned to the roller 24 and is preferably constructed as a sieve strip and is pressed against the yarn and the guiding surface 40. The sieve belt moves tangentially with respect to the roller 24 and in the direction of the yarn duct of the false-twisting nozzle 16. The sieve belt 72, which is guided around pulleys 73 and 74 advantageously has its own drive so that the end of the belt resting against the yarn is driven in the direction of the arrow (F). The speed of the sieve belt 72 is exactly that of the circumferential speed of the roller 24 and possibly slightly higher so that the aligning of the fiber ends is promoted further.

Figure 13:
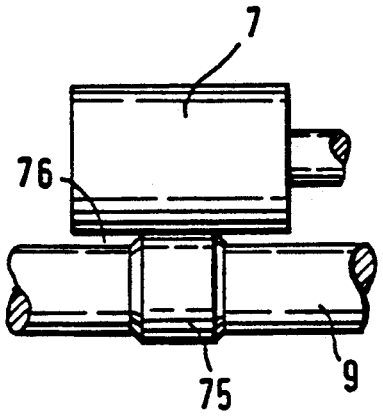
FIG. 13 is a view of a pair of delivery rollers of a drafting unit with a nip line which is shortened in the axial direction.
Figure 14:
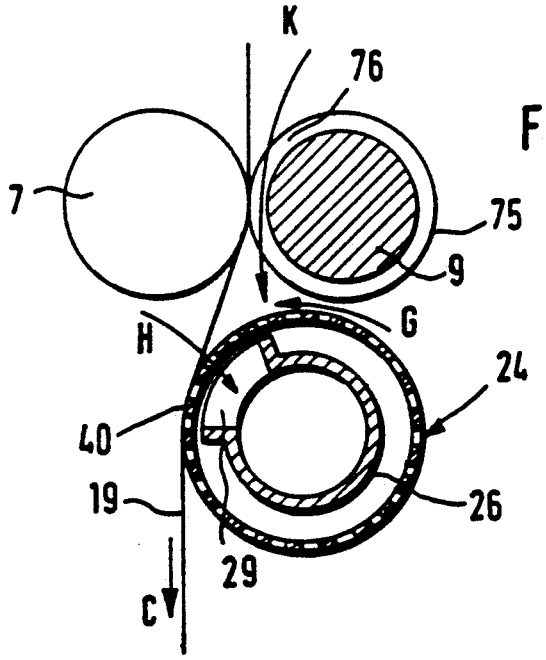
FIG. 14 is lateral view of a pair of delivery rollers corresponding to FIG. 13 and of a roller-shaped guiding element which follows, according to an embodiment of the invention.

In the embodiment according to FIG. 13 and 14 which, in principle, corresponds to the embodiment according to FIG. 1 and 2, it is provided that the bottom roller 75 arranged on the shaft 9 is shortened in the axial direction with respect to the pressure roller 7. A clamping gap is created in this manner which is relatively short in the axial direction. As a result, it is also achieved that the air taken in by the suction device 26 by way of the suction slot 29 can approach not only in the direction of the arrows (G and H) but also in the direction of the arrow (K) through the gaps 76 between the pressure roller 7 and the bottom roller 75. As a result, an air flow can be produced in the direction of the arrow (K) which is essentially directed in the travelling direction of the yarn 19 so that in the area of the relatively weak false twist, a detaching and moving-ahead of the fiber ends or edge fibers can already be achieved also pneumatically.

Even if guiding elements 24 are provided in all embodiments which cooperate with a suction device, it is naturally also within the scope of the present invention that corresponding guiding elements are provided without an additional suction device. Under certain circumstances, it is necessary in this case to provide these guiding elements in the area of the guiding surfaces 40 with a special friction lining which makes it possible to detach the fiber ends and accelerate them more while, however, the yarn core maintains the speed and is not drafted. It is conceivable, for example, to provide the friction lining as a plush or the like.

The guiding elements subjected to the suction have the advantage that with their aid it is possible to hold the yarns in the area of the guiding elements 24 when the arrangement is stopped. In this case, it is possible to switch off the suction effect on the guiding elements 24 only after all other elements were shut down. If necessary, it may also be provided that during the stoppage the suction device is still acted upon by a vacuum which, however, is reduced so that the yarns are held on the guiding surface 40. In another embodiment, it is provided that the yarns, after the machine is shut down, are secured by auxiliary mechanical devices. It is possible, for example, to bring a preferably cushioned pressing device to come to rest against the guiding surface 40 which then, when the machine is stopped, clamps the yarn located there and which holds this yarn until the machine is restarted. In this case, it may be useful to not restart the machine before the yarn moves again and was sucked into the false-twisting device 2.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for false-twist spinning comprising:

a drafting unit for drafting sliver, at least one false-twisting nozzle arranged downstream of the drafting unit for false-twisting sliver to form a yarn, a withdrawal device arranged downstream of the at least one false-twisting nozzle, and a guiding element which is arranged between the drafting unit and the false-twisting nozzle, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions.

2. An arrangement according to claim 1, wherein the speed of the guiding surface is 1.3 times to 1.8 times the delivery speed of the drafting unit.

3. An arrangement according to claim 2, wherein a pair of parallelly disposed false-twisting nozzles are provided for applying false-twist to respective separate slivers, and wherein a common guiding element is arranged between a common drafting unit and the nozzles for the respective slivers.

4. An arrangement according to claim 1, wherein the guiding surface is a cylindrical surface.

5. An arrangement according to claim 4, wherein the speed of the guiding surface amounts to 1.3 times to 1.8 times the delivery speed of the drafting unit.

6. An arrangement according to claim 1, wherein the guiding surface is a conical surface.

7. An arrangement according to claim 6, wherein the speed of the guiding surface amounts to 1.3 times to 1.8 times the delivery speed of the drafting unit.

8. An arrangement according to claim 1, wherein the guiding surface is a disk surface.

9. An arrangement according to claim 8, wherein the speed of the guiding surface amounts to 1.3 times to 1.8 times the delivery speed of the drafting unit.

10. An arrangement according to claim 1, wherein the guiding element is connected to the drafting unit by means of a drive transmission device.

11. An arrangement according to claim 1, wherein the guiding elements of several adjacent spinning points are provided with a common drive.

12. An arrangement according to claim 1, wherein a yarn contact pressure device which is equipped with a separate drive is assigned to the guiding surface.

13. An arrangement according to claim 1, wherein the length of the guiding surface in the travelling direction of the yarn is adapted to the staple length of the fiber material to be processed and is 3 times to 8 times the staple length.

14. An arrangement according to claim 13, wherein the speed of the guiding surface amounts to 1.3 times to 1.8 times the delivery speed of the drafting unit.

15. An arrangement according to claim 1, wherein the guiding surface is constructed as a friction surface.

16. An arrangement according to claim 1, wherein the guiding surface is perforated, and wherein a suction device is arranged which generates an air flow passing through the guiding surface.

17. An arrangement according to claim 16, wherein the suction device is provided with a suction slot pointing in the travelling direction of the yarn.

18. An arrangement according to claim 16, wherein, in the travelling direction of the yarn, the suction device is divided into several sections having a suction effect of different intensities.

19. An arrangement according to claim 1, wherein a suction device is assigned to the guiding surface which is disposed outside the guiding element and generates an air flow directed away from the guiding surface.

20. An arrangement according to claim 1, wherein the at least one false-twisting nozzle is arranged in a tangential plane extending from the withdrawal device to the guiding surface.

21. An arrangement according to claim 1, wherein the false-twisting nozzle, which follows the guiding element, has an inlet area with a recess which is adapted to the guiding element.

22. An arrangement according to claim 1, wherein devices are assigned to the guiding element for dividing the sliver delivered by the drafting unit in the traverse direction.

23. An arrangement according to claim 1, wherein a pair of parallelly disposed false-twisting nozzles are provided for applying false-twist to respective separate slivers, and wherein a common guiding element is arranged between a common drafting unit and the nozzles for the respective slivers.

* * * * *